US009938669B2

(12) United States Patent
Boyd et al.

(10) Patent No.: US 9,938,669 B2
(45) Date of Patent: Apr. 10, 2018

(54) ROADWORTHY RAIL BALLAST REGULATOR

(71) Applicant: Nordco Inc., Oak Creek, WI (US)

(72) Inventors: James William Boyd, Fox Point, WI (US); David A. Spence, Hartland, WI (US); Justin Jerome Pipol, Union Grove, WI (US); Michael David Thompson, Oak Creek, WI (US)

(73) Assignee: NORDCO INC., Oak Creek, WI (US)

( * ) Notice: Subject to any disclaimer, the term of this patent is extended or adjusted under 35 U.S.C. 154(b) by 265 days.

(21) Appl. No.: 14/856,178

(22) Filed: Sep. 16, 2015

(65) Prior Publication Data

US 2016/0108582 A1 Apr. 21, 2016

Related U.S. Application Data

(60) Provisional application No. 62/064,747, filed on Oct. 16, 2014.

(51) Int. Cl.

| | |
|---|---|
| ***E01B 27/02*** | (2006.01) |
| ***E02F 3/76*** | (2006.01) |
| ***E02F 3/815*** | (2006.01) |
| ***E02F 9/02*** | (2006.01) |

(52) U.S. Cl.

CPC ..... *E01B 27/025* (2013.01); *E01B 27/026* (2013.01); *E02F 3/7604* (2013.01); *E02F 3/7631* (2013.01); *E02F 3/8152* (2013.01); *E02F 9/022* (2013.01)

(58) Field of Classification Search

CPC .. E01B 27/025; E01B 2201/10; E01B 27/026; E01H 5/068; E01H 5/066; F16B 5/0024; F16B 5/0028; F16B 5/0056; F16B 5/0072; F16B 5/0642; F16B 5/123; F16B 5/126; F16B 5/07; F16B 13/00; F16B 13/005; F16B 19/109; Y10T 29/4995; Y10T 29/49895; Y10T 29/49899; E02F 3/7604; E02F 3/7631; E02F 3/8152; E02F 9/022

USPC ..... 52/127.2, 126.1, 126.3; 37/233, 449; 172/772; 29/760, 281.6; 411/134, 528, 411/27; 248/544

See application file for complete search history.

(56) References Cited

U.S. PATENT DOCUMENTS 1,740,739 A * 12/1929 Kipp ..... A01B 35/26 172/762
2,061,585 A 11/1936 Meyer
3,085,635 A * 4/1963 Livermore ..... A01B 15/025 172/699
3,197,895 A 8/1965 Cooke
(Continued)

OTHER PUBLICATIONS

Extended European Search Report from European Patent Application No. 15190196.4, dated May 3, 2016.

*Primary Examiner* — Jamie L McGowan
(74) *Attorney, Agent, or Firm* — Greer, Burns & Crain, Ltd.

(57) ABSTRACT

A regulator moldboard and grader blade assembly includes a moldboard having at least one transversely extending pin, the pin having a notch with a surface inclined toward the moldboard. At least one grader blade has at least one mounting opening having a flared surface complementary to the notch so that the blade is hangable on the pin so that the notch draws the blade against the moldboard as a fastener tightens the blade to the moldboard.

8 Claims, 9 Drawing Sheets

(56) References Cited

U.S. PATENT DOCUMENTS

| | | | | |
|---|---|---|---|---|
| 3,456,370 | A * | 7/1969 | Gilbertson | E02F 3/8152 172/701.2 |
| 3,579,873 | A | 5/1971 | Kershaw | |
| 3,736,664 | A * | 6/1973 | Black | E02F 3/65 37/446 |
| 3,888,027 | A | 6/1975 | Toews | |
| 4,073,076 | A | 2/1978 | Fortune | |
| 4,275,514 | A | 6/1981 | Maura | |
| 4,290,214 | A | 9/1981 | Stepe | |
| 4,707,935 | A | 11/1987 | Cicin-Sain | |
| 4,715,450 | A | 12/1987 | Hallissy et al. | |
| 4,741,072 | A | 5/1988 | Wilkerson | |
| 4,803,790 | A | 2/1989 | Ciula | |
| 4,823,816 | A * | 4/1989 | Maruska | A01F 11/06 144/241 |
| 4,833,801 | A | 5/1989 | Winter | |
| 4,899,472 | A | 2/1990 | Winter | |
| 4,962,600 | A | 10/1990 | Zellaha et al. | |
| 5,020,603 | A | 6/1991 | Harrell | |
| 5,407,310 | A * | 4/1995 | Kassouni | B29C 70/76 29/525.02 |
| 5,636,458 | A | 6/1997 | Drake | |
| 5,743,032 | A | 4/1998 | Vauhkonen | |
| 6,186,245 | B1 * | 2/2001 | Skjaeveland | A01B 15/06 172/772 |
| 6,240,662 | B1 | 6/2001 | Borowiak | |
| 6,276,075 | B1 | 8/2001 | Kost et al. | |
| 6,408,549 | B1 | 6/2002 | Quenzi et al. | |
| 6,612,050 | B2 | 9/2003 | Takeuchi | |
| 6,883,436 | B2 | 4/2005 | Fuerst | |
| 7,171,770 | B2 | 2/2007 | Schultz et al. | |
| 7,836,615 | B2 | 11/2010 | Winter | |
| 7,874,085 | B1 | 1/2011 | Winter et al. | |
| 8,127,471 | B2 | 3/2012 | Stevens et al. | |
| 8,191,287 | B2 | 6/2012 | Winter et al. | |
| 8,209,887 | B2 | 6/2012 | Ghosh | |
| 8,499,477 | B2 | 8/2013 | Gamble, II | |
| 2001/0009077 | A1 | 7/2001 | Pitts | |
| 2004/0231201 | A1 | 11/2004 | Hamel | |
| 2005/0178029 | A1 | 8/2005 | Wightman | |
| 2006/0005435 | A1 | 1/2006 | Gamble, II et al. | |
| 2006/0108200 | A1 * | 5/2006 | Peterson | B65G 45/16 198/497 |
| 2006/0242840 | A1 * | 11/2006 | Sullivan | H02G 1/1202 30/142 |
| 2007/0113483 | A1 * | 5/2007 | Hernandez | F16B 5/0664 49/502 |
| 2013/0145658 | A1 | 6/2013 | Tordik | |
| 2014/0083725 | A1 | 3/2014 | Linder et al. | |

* cited by examiner

ROADWORTHY RAIL BALLAST REGULATOR

RELATED APPLICATION

This application is a Non-Provisional of, and claims 35 USC 119 priority from, U.S. Provisional application Ser. No. 62/064,747 filed Oct. 16, 2014.

BACKGROUND

The present invention relates generally to railroad right of way maintenance equipment, and specifically to machinery for forming and/or shaping rail track ballast in conjunction with railroad track repair, replacement or reconditioning.

Crushed rock rail ballast forms the support bed into which rail ties are inserted for receiving tie plates, spikes or other fasteners, and ultimately the rails. Ballast supports the weight of loaded trains, and also is sufficiently porous to allow the drainage of standing water from the typically wooden ties. Also, the ballast provides the ability to maintain a constant rail/ground displacement or grading over varying terrain and soil conditions.

During railway maintenance operations, including but not limited to tamping, tie replacement, rail replacement or the like, the ballast becomes disrupted and must be reshaped. The optimal shape of rail ballast is a generally level upper surface in which the ties are embedded, and a pair of gradually sloping sides which flare out from ends of the rail ties at a specified angle or angular range which is generally constant across the railroad industry. However, depending on the application and available space, the angle of the ballast may vary.

To achieve the desired angular slope, ballast regulators are employed, which are either self-propelled or towed, and feature at least one articulated, fluid-powered wing arm having at least one blade attached. Similar in function to a highway snowplow, the blade is oriented at a desired angle and is pushed by the ballast regulator through the ballast as the regulator moves along the track. To facilitate the reuse of ballast stones dislodged during the regulation of the ballast, it is typical for a wing to include a main outer door and laterally oriented template doors. The template doors are pivotally connected to side edges of the outer door, and through the use of fluid-powered cylinders, the position of the template doors relative to the outer door can be adjusted to form "C-", "U-" or similarly shaped configurations to retain a supply of disrupted ballast as the regulator moves along the track. In this way, there is sufficient ballast to fill in any depressions encountered to maintain a uniform slope. An exemplary rail ballast regulator is disclosed in U.S. Pat. No. 6,883,436, which is incorporated by reference.

One drawback of conventional ballast regulators is that when they are transported from one maintenance location to another, they must be towed on a trailer by a semi-tractor. Due to the size and/or weight of the regulator, special oversize use permits are often required for on-road transport by the U.S. Department of Transportation for carrying the machine on a highway. Moreover, once the machine reaches its destination, a heavy-duty lifting machine such as a crane, is needed to move the regulator onto the railway track for operation. Accordingly, the transportation of conventional rail ballast regulators is inconvenient and cumbersome, and incurs high shipping costs due to the above-described difficulties. Also, in some cases, these transportation difficulties make it less convenient for locating regulators sufficiently close to the desired worksite.

Another drawback of conventional ballast regulators is that the wing or plow blades are subject to extreme abrasion as they work through the ballast. Sacrificial wear plates are commonly fastened to the main blades for exposure to the ballast while protecting the blades. These plates are fastened to the blade sandwich style using threaded bolts and nuts. However, through extended exposure to rail ballast, the nuts and/or bolt heads often become worn down so that the facets are obliterated, or in any event are unsuitable for removal using conventional tools. Thus conventional maintenance of regulators includes using torches or other heavy equipment for removing the blade wear plates. Another disadvantage of conventional wing wear plates is that more than one operator is required for placing them on the wing blade. The plates often weigh as much as 50 pounds, and must be held in place by one operator so that the fasteners can be inserted through corresponding holes in the plate and blade by the other operator.

Thus, there is a need for an improved rail regulator that is roadworthy without requiring special use permits. There is also a need for an improved regulator blade where the wear plates are resistant to ballast abrasion so that replacement is facilitated.

SUMMARY

The above-identified needs are met by the present roadworthy regulator, featuring an improved ballast wing pivot assembly that is mounted to the main regulator frame for providing a narrower profile for on-road transport. Another feature is that the rail broom is also movable to a transport or travel position providing a reduced width to the assembly. Once components are pivoted to the travel position, the present regulator is towable as a trailer by a standard semi tractor truck. Further, the present chassis is constructed and arranged so that it meets standard Department of Transportation width and weight regulations for towed semi-type trailers, and does not require special Oversize or Overweight permits. In the travel position, the present regulator has a width not exceeding 96 inches, and a rear axle weight limit of 40,000 pounds.

One factor in achieving roadworthiness is that the wing pivot mounts are located on an upper surface of the frame and are generally vertically projecting. In a retracted position, the wings create the desired 96 inch maximum width for the regulator in a travel position.

In the present regulator, in a working position, the broom assembly extends from an end of the main machine frame. For best results, rail brooms are wider than the track for providing sufficient sweeping area needed to satisfactorily cover the track area. Such extra length means that conventional brooms are unsuitable for on-road transport. However, using an improved linkage, the broom is retracted and lifted from an operational position adjacent the track. Then, using an on-frame turntable, the broom assembly is pivoted generally 90° so that a longitudinal axis of the broom is generally aligned with a longitudinal axis of the main machine frame. In this storage position, on-road transport is facilitated.

Still another feature of the present regulator is an improved wing blade wear plate attachment system, featuring locating pins fixed to the blade that allow an operator to single handedly hang the plate on the blade without the use of tools. In addition, specially inclined surfaces on the pins define a plate seat and thus direct the plate towards the blade and enhance the retaining powers of fasteners. Also, protective, sacrificial nut cups are employed for being the point of exposure to the abrasive ballast, protecting facets on the nuts while allowing sufficient clearance for sockets when removal is needed. Conical ends of the caps more easily locate in corresponding openings in the wear plates to more positively hold the plates to the moldboard. Using the present plate assembly, the plates are removable from one side of the wing or blade.

Once the plate is in place on the blade, the pins are protected from ballast wear by the plates themselves. The present wear plates are also reversible, and can be mounted on either side of the plow wing or blade, also referred to as a moldboard.

Another component of the present assembly is a filler bar placed between plates and in a gap formed by lower edges of the plates as they sandwich the moldboard. The filler bar has laterally-extending lugs that matingly engage sockets in inner surfaces of the plates for retaining the bar in position. Preferably, the filler bar is constructed and arranged so that ballast particles cannot become wedged between the plates. In the past, such particles have caused bending and/or separation of the plates from the moldboard.

More specifically, a regulator wing blade and wear plate assembly is provided and includes a moldboard having at least one pin extending transversely to the blade, and having a notch with a surface inclined toward the moldboard. At least one grader blade has at least one mounting opening having a flared surface complementary to the notch so that the plate is hangable on the pin so that the notch draws the blade against the blade as a fastener tightens the blade to the moldboard.

In another embodiment, a ballast regulator is provided, including a main frame defining a longitudinal axis, a first side, a second side and an upper surface. A pair of wing pivot brackets is spaced along the axis and secured to and projecting from the upper surface. A regulator wing and telescoping beam assembly is associated with at least one of the frame sides, and each beam assembly includes a mounting end dimensioned for being pivotally mounted to the mounting ears so that each beam is movable between a work position extending from the sides, and a retracted travel position, where the assembly is pulled up over the upper surface for reducing the travel width of the regulator.

In still another embodiment, a ballast regulator is provided and includes a main frame having a longitudinal axis. A broom assembly is associated with an end of the frame and includes a shroud, and a shroud bracket movably connected to the main frame. A turntable is located on an upper surface of the shroud bracket, and the shroud being pivotably mounted to the shroud bracket vi the turntable between an operational position wherein the broom element extends along a broom axis perpendicular to the frame axis, and a travel position wherein the broom axis is generally parallel to the frame axis.

DETAILED DESCRIPTION

Figure 1:
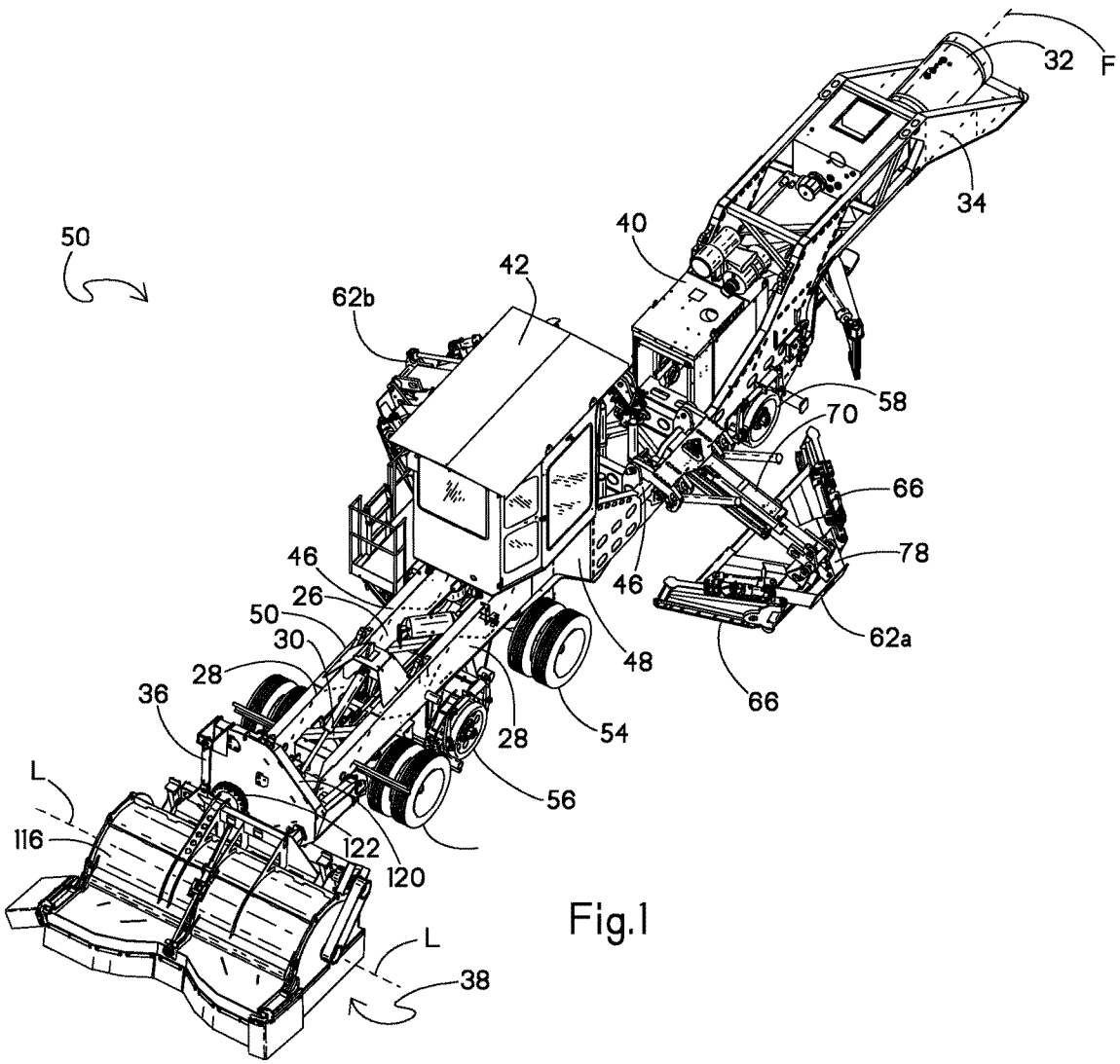
FIG. 1 is a top perspective view of the present regulator, showing the wings and the broom in the working position.
Figure 2:
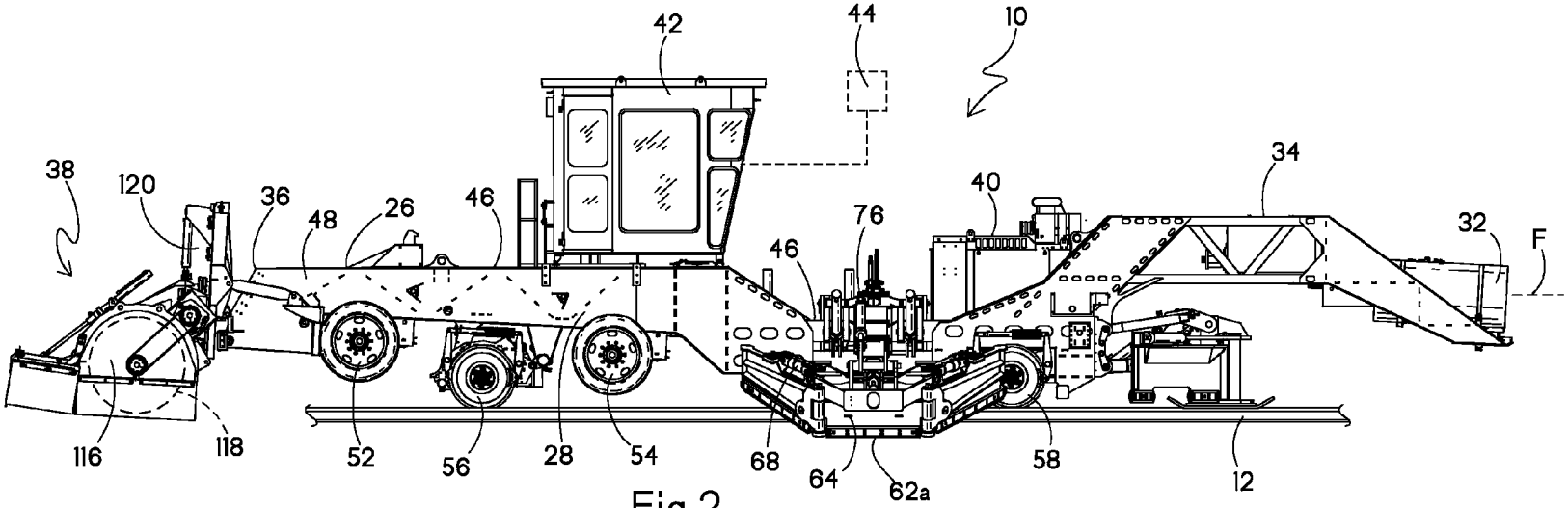
FIG. 2 is a side elevation of the regulator of FIG. 1.
Figure 3:
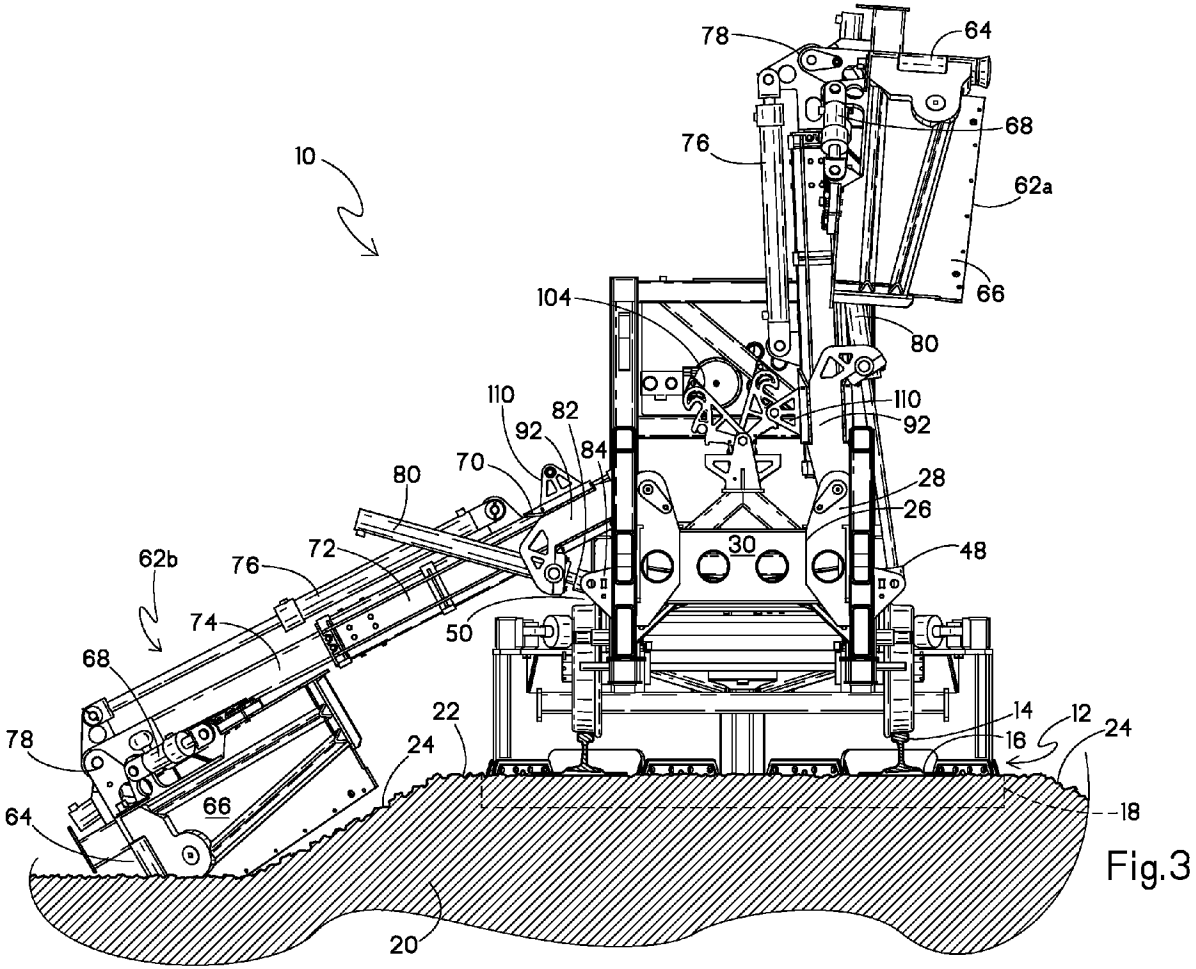
FIG. 3 is a front view of the present regulator, showing a wing on one side in a working position, and on the opposite side in a raised, travel position.

Referring to FIGS. 1-3, the present roadworthy rail ballast regulator is generally designated 10, and is disposable on a railroad track 12 (FIG. 3) including a pair of parallel rails 14 mounted via tie plates 16 to typically wooden or concrete ties or sleepers 18 (shown hidden). The track 12 is supported by particulate ballast 20, usually made of crushed rock. FIG. 3 depicts a desired operational profile of the ballast 20, including a generally flat or horizontal upper surface 22 and a pair of angled, sloping sides 24, defining an angle of approximately 30 to 40° relative to the (horizontal) ground, and this angle may vary to suit the situation.

As seen in FIGS. 1 and 2, the regulator 20 includes an elongate frame 26, preferably defining a general "ladder" shape with a pair of spaced, generally parallel main elongate beams 28 supported by transverse braces 30 as known in the art of rail maintenance machinery. The frame has a front end 32 with a "gooseneck" 34 for facilitating mounting of the regulator to a semi-trailer tractor (not shown) in a manner similar to conventional trailers or towed equipment. Opposite the front end 32 is a rear end 36, shown equipped with a rail broom assembly, generally designated 38 and shown in a lowered or working position.

Also included on the frame 26 is a regulator power source 40, such as a diesel engine driving a hydraulic system for operating the components and for propelling the regulator 10 along the track 12. Other suitable power sources are contemplated as are known in the art. An operator's cab 42 provides a workstation for at least one operator and includes a control system 44 (shown in phantom) for operating the various features of the regulator 10. Also, the cab 42 is disposed on the frame 26 to enhance operator visibility of the ballast regulating and track sweeping operations described in more detail below.

An upper surface 46 of the frame 26 is defined by the main beams 28, which also define frame sides 48 and 50. As seen in FIGS. 1 and 2, the operator's cab 42 is secured to the frame upper surface 46. First and second sets of road wheels 52, 54 are mounted to the frame 26 for supporting the regulator 10 during highway travel. The number and location of the sets of road wheels 52, 54 are selected for accommodating the weight of the regulator 10, as well as for distributing the load on the road in compliance with highway regulations. The present regulator 10 is designed so that the road wheels do not support more than 20,000 pounds per axle. It is contemplated that the sets of road wheels 52, 54 are provided with brakes and suspensions as needed and as known in the art, and will not be disclosed further here.

For travel on the track 12, the regulator 10 is provided with at least one and preferably two sets of rail wheels 56, 58, projecting from an underside 60 of the frame 26. At least one of the sets 56, 58 is retractable relative to the frame 26 for facilitating highway travel.

Besides the broom 38, the main operational components of the regulator 10 are a pair of regulator wings, generally designated 62*a* and 62*b*. Each wing 62*a*, 62*b* projects from a corresponding side 48, 50 of the frame 26, and operate between a working or lowered position (FIGS. 1 and 2) and a raised or travel position (FIG. 3). A main outer door 64 (FIG. 2) is hingedly connected to a pair of template doors 66. As is known in the art, the relative position of the template doors 66 relative to the outer door 64 is adjustable using fluid power cylinders 68 under operator control, as described in one embodiment in greater detail in commonly-assigned U.S. Pat. No. 6,883,436 incorporated by reference.

Figure 4:
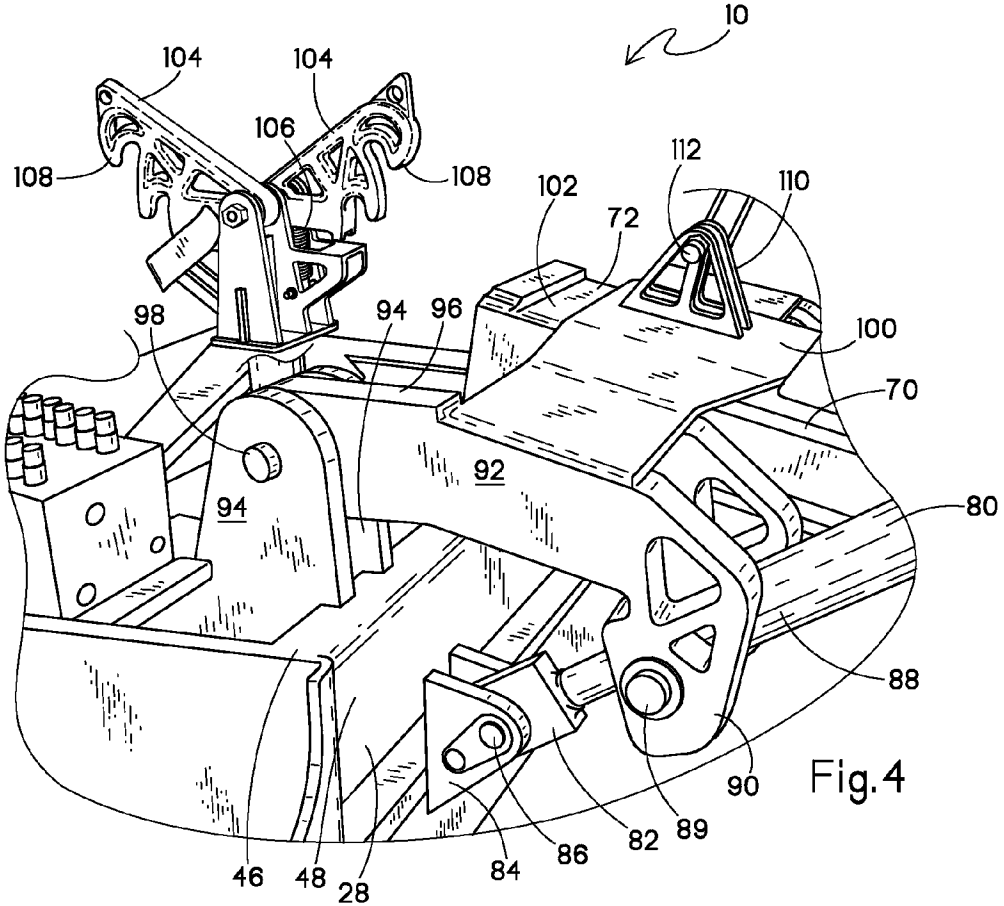
FIG. 4 is an enlarged fragmentary top perspective view of the regulator of FIG. 1 showing the mounting of the wings to the frame.

Referring now to FIGS. 3 and 4, each wing 62*a*, 62*b* is connected to the frame 26 by a telescoping boom 70, including a base tube 72 and an extendable inner tube 74 movable by extension and retraction of a fluid power boom cylinder 76 under operator control. The wing 62*a* is connected to the inner tube 74 using a wing bracket 78.

Each wing 62*a*, 62*b* is movable between the working position and the travel position (both shown in FIG. 3) by at least one and preferably a pair of wing lift cylinders 80 preferably pivotably connected at a rod end 82 to ear brackets 84 projecting from a corresponding side 48 of the frame 26, and forming a clevis into which the rod end 82 is inserted and held by a suitable pivot pin 86. A cylinder housing 88 of the wing lift cylinders is pivotably connected using a pin 89 to a clevis bracket 90 of a wing pivot arm 92, which is connected at an opposite end from the clevis bracket 90 to at least one, and preferably at least a pair of axially spaced wing pivot brackets 94 projecting from the upper frame surface 46 to form another clevis-type pivot point 96 receiving the pivot arm 92 and being completed using a pivot pin 98. In the preferred embodiment, there are a pair of wing pivot arms 92 on each side 48, 50 of the frame 26 and a beam plate 100 is secured between and to each of the arms 92 and to a rear or mounting end 102 of the base tube 72 for pivotably securing the boom 70 to the frame 26.

As the wing lift cylinders 80 are selectively pressurized, the clevis bracket 90 of the wing pivot arm 92 pivots away from the side 48, 50 of the frame 26 and ultimately reaches a relatively vertical position, seen on the right in FIG. 3. In this manner, the wings 62*a*, 62*b* are moved from the working position to the travel position. A pivoting wing latch 104 operated by a preferably spring-return latch cylinder 106 includes a hook 108 for engaging a complementary beam bracket 110 projecting generally vertically from the beam plate 100 and having a latch pin 112 engageable by the hook 108. In this manner, the wings 62*a*, 62*b* and the associated booms 70, collectively referred to as the regulator wing and boom assembly 114, are secured in the travel position. Once the regulator 10 has completed its travel and is being readied for regulating work, the wing latch cylinders 106 release the hooks 108 and the wing lift cylinders 80 are depressurized so that the wings 62*a*, 62*b* are lowered to the working position. It will be understood that the above discussion of pressurization of the cylinders is in the context of a single-acting cylinder, and that the use of suitable double-acting cylinders is also contemplated throughout the regulator 10.

Referring now to FIGS. 1 and 5-7, operation of the broom 38 between the working and the travel position is described in greater detail. In general, the broom 38 is moved from the working or "work down" position (FIG. 1), in which a longitudinal axis "L" of the broom is transverse to a longitudinal axis "F" of the frame 26, then is lifted from the working position to a "work up" position, and is then rotated about a generally vertical axis so that the longitudinal axis "L" is parallel to the axis "F". Once the broom 38 is in the travel position (FIG. 6), the maximum 96 inch width of the regulator 10 is in compliance with highway regulations for conventional semi-trailers.

The broom 38 includes a shroud 116 enclosing a rotating, bristled, broom element 118 (shown hidden in FIGS. 2 and 5), and a shroud bracket 120 projecting from the shroud, so that from the side, the shroud and the shroud bracket form a general "L"-shape (FIG. 2). A turntable 122 is located on an upper surface 124 of the shroud bracket 120, and includes a shroud turntable cylinder 126 constructed and arranged for rotating the shroud about a vertical axis of said turntable. More specifically, the shroud 116 is pivotably mounted to the turntable 122 for operation between an operational position, wherein the shroud axis "L" extends perpendicular to the frame axis "F", and the travel position wherein the broom axis is generally parallel to the frame axis. Also, the shroud turntable cylinder 126 is mounted in an off-center or offset location on the shroud bracket 120 relative to the turntable 122 for pivotably moving the shroud between the above-identified axial alignments. One end of the turntable cylinder 126 is mounted to the shroud bracket at 127, and the other end is mounted to the shroud 116 at 128, both using pivoting clevis-type mounts as described above, or the like.

Figure 7:
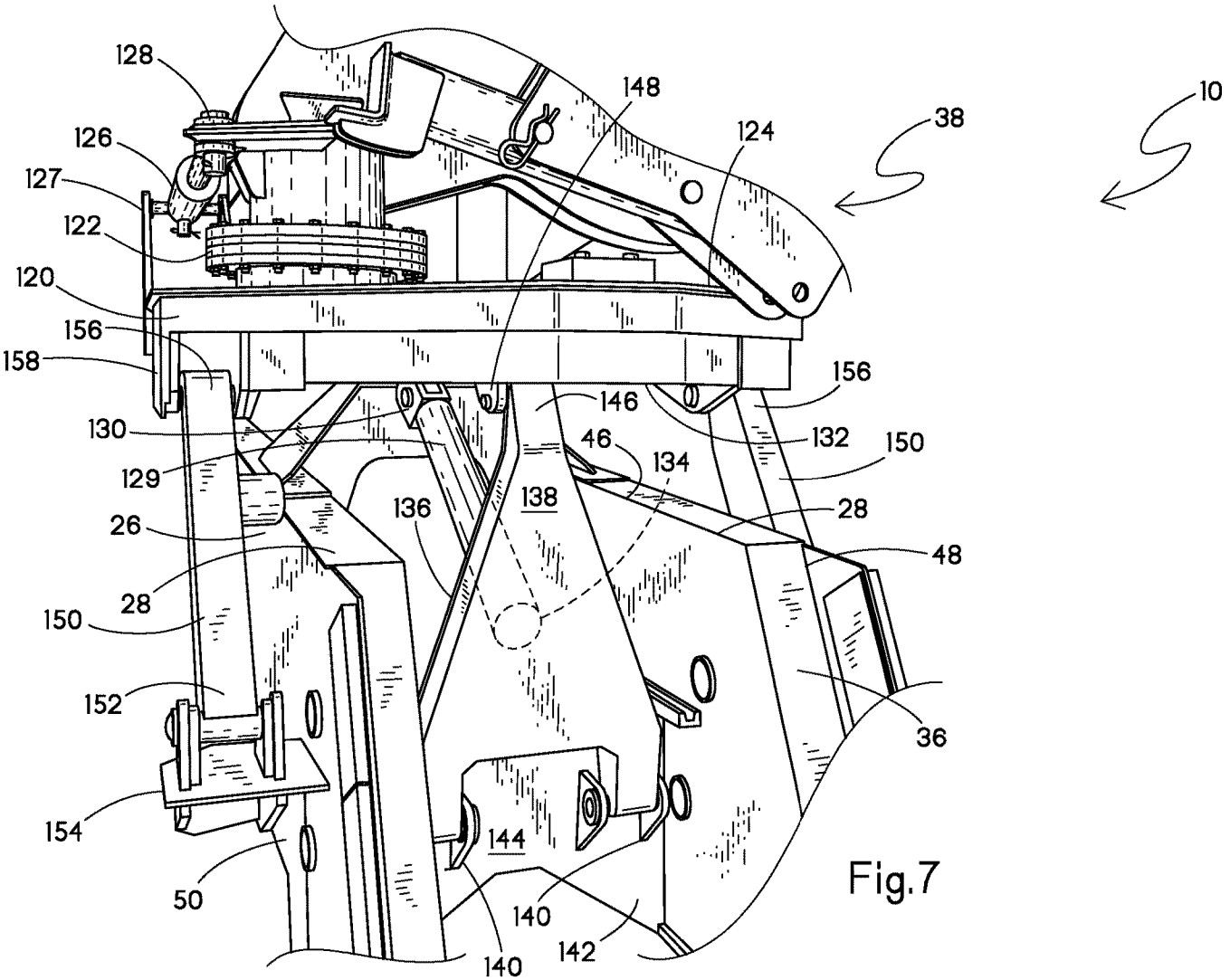
FIG. 7 is a fragmentary rear perspective view of the regulator of FIG. 6 showing the broom movement mechanism.

Referring now to FIG. 7, in addition, the broom assembly 38 is movable between the working and travel positions upon selected pressurization of a broom cylinder 129 located between the frame beams 28 and mounted at a first end 130 to an underside 132 of the shroud bracket 120, and at an opposite end 134 to an upper surface 136 of a generally "Y"-shaped broom arm 138 (FIG. 7). The broom arm 138 is pivotally mounted to associated broom arm brackets 140 on a rear surface 142 of a frame cross member 144 located between the frame beams 28 near the frame rear end 36. An upper end 146 of the broom arm 138 is pivotably mounted to the underside 132 of the shroud bracket 120 in a position 148 axially displaced along frame axis "F" from the mounting point of the first end 130 of the broom cylinder 128.

In addition to the broom arm 138, the regulator 10 also has broom links 150 preferably located on either side of the frame 26 adjacent the sides 48, 50, with one end 152 of the links pivotably mounted to the frame 26 at flanges 154 projecting from the sides 48, 50. Opposite ends 156 of the broom links 150 are each connected to brackets 158 depending from the underside 132 of the shroud bracket 120.

Figure 5:
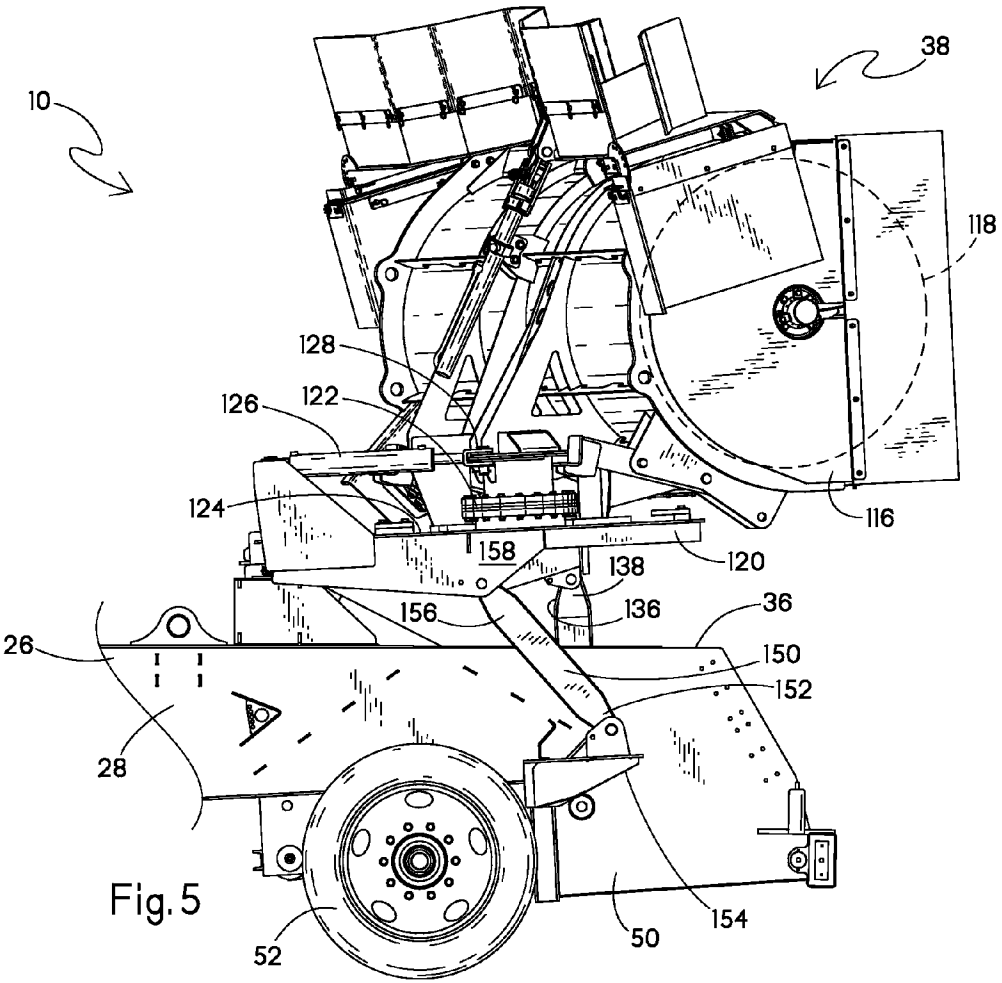
FIG. 5 is a fragmentary side elevation of the present regulator showing the broom assembly in an elevated position.
Figure 6:
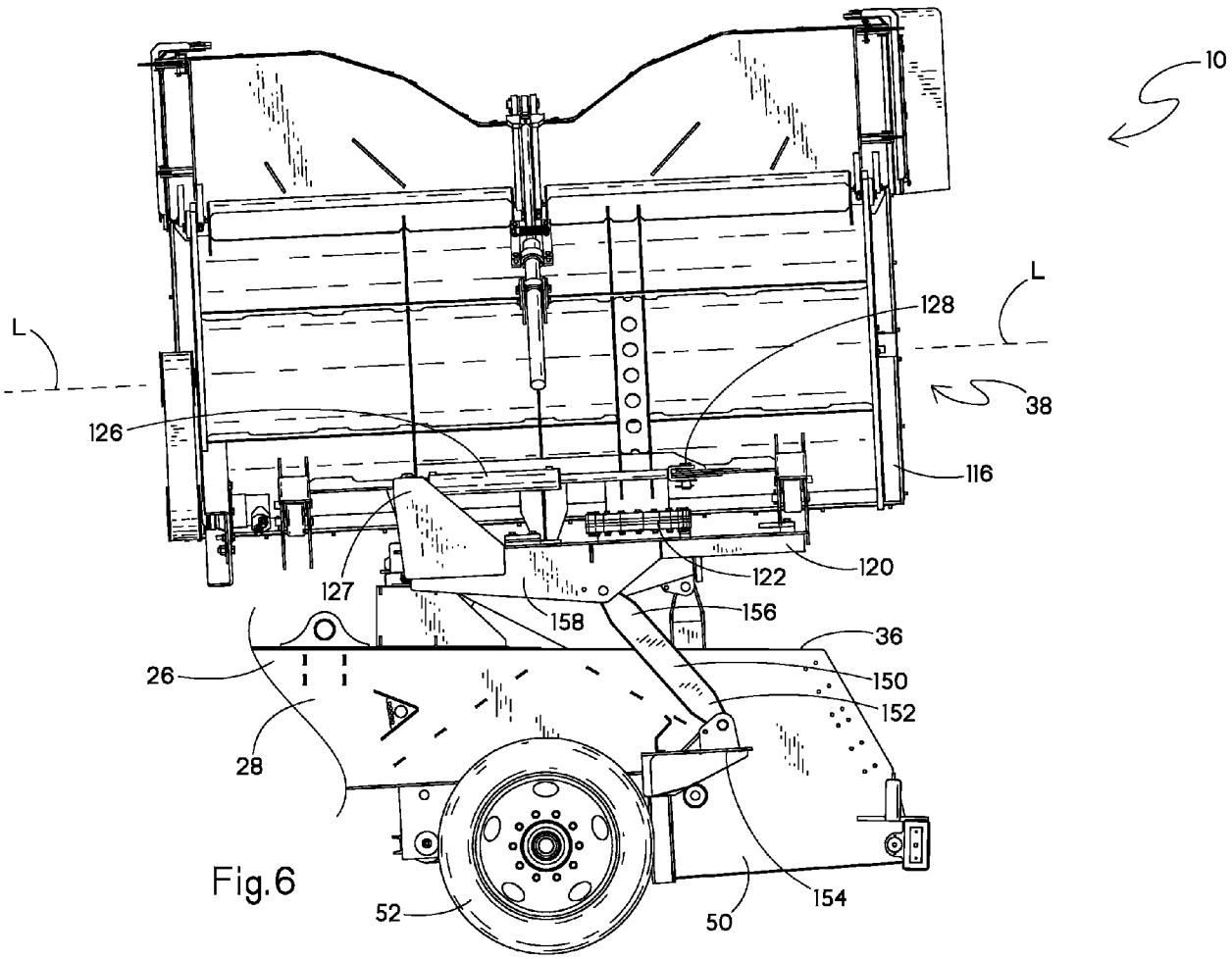
FIG. 6 is a fragmentary side elevation of the regulator of FIG. 5 showing the broom assembly in the rotated or travel position.

Selective pressurization of the broom cylinder 129 causes movement of the shroud bracket 120, under control of the broom arm 138 and the broom links 150, between the "work down" position of FIG. 1 and the "work up" position of FIG. 5. Once the "work up" position is achieved, selective pressurization of the shroud turntable cylinder 126 causes rotation of the shroud 116 from the "work up" position to the travel position, seen in FIG. 6, in which the axis "L" of the shroud is generally parallel with the frame axis "F."

Referring now to FIGS. 3, 8-13, the wings 62*a*, 62*b* each preferably have the outer doors 64 and the template door 66 equipped with specialized, removable wear-resistant grader blades 160 mounted to the underlying plate or moldboard 162 which is suspended from the corresponding wing 62*a*, 62*b*. The grader blades 160 are each supported on a corresponding one of the moldboards 162, and form the main contact surface engaging the rail ballast 20. As described above, the ballast 20 is very abrasive on maintenance equipment. The features of the present regulator 10 include that the removable grader blades 160 are more easily replaced by a single operator, and are secured in a way that the fasteners 164, typically threaded bolts and nuts are less prone to abrasion.

More specifically, the moldboard 162 is provided with at least one and preferably a plurality of transverse guide pins 166 located in spaced relationship along a line paralleling a longitudinal axis of the moldboard, and near a lower edge 168 of the moldboard. The pins 166 are fastened, as by welding or the like, into corresponding throughbores 170 in the moldboard. Each pin 166 projects transversely from front and rear surfaces 172, 174 of the moldboard.

Figure 12:
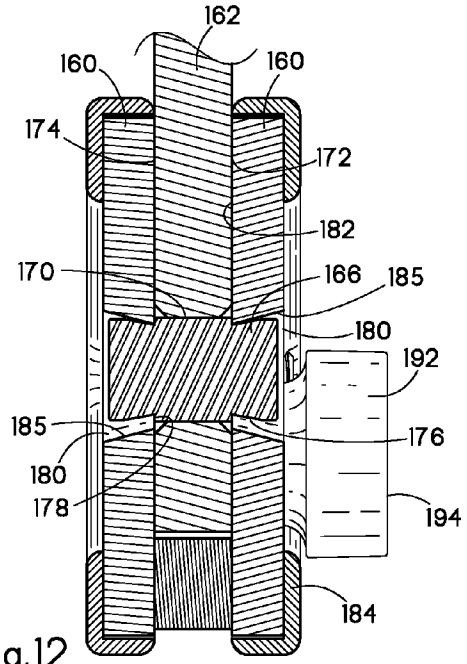
FIG. 12 is a cross-section taken along the line 12-12 of FIG. 9 and in the direction generally indicated.
Figure 13:
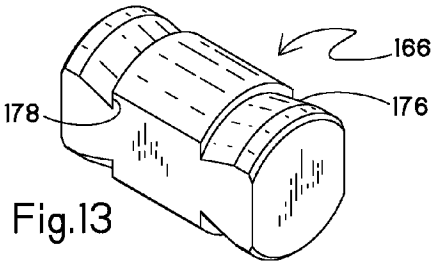
FIG. 13 is a top perspective view of the present regulator blade pin.

As best seen in FIGS. 12 and 13, each pin 166 has an annular notch 176 defining a surface inclined toward the moldboard 162. The inclined surface of the annular notch 176 forms a frusto-conical shape tapering or narrowing toward the moldboard 162.

A generally vertically projecting shoulder 178 defines an end of the surface of the notch, and is flush with the corresponding surfaces 172, 174 upon installation (FIG. 12). Thus, the pins 166 have ends forming the inclined surfaces 176 extending from each surface 172, 174. Each grader blade 160 has a corresponding number of mounting openings 180 configured for engaging the pins 166. It is preferred that the openings 180 are outwardly flared from a moldboard engaging surface 182 to an outer surface 184, so that an inclined surface 185 is defined that is complementary to the annular notch 176 on the pins. This complementary relationship with the pins 166 causes the grader blade 160 to slide towards, and to be drawn tighter against the moldboard 162 as the blade is progressively secured to the moldboard using the fastener 164.

Figures 8, 9:
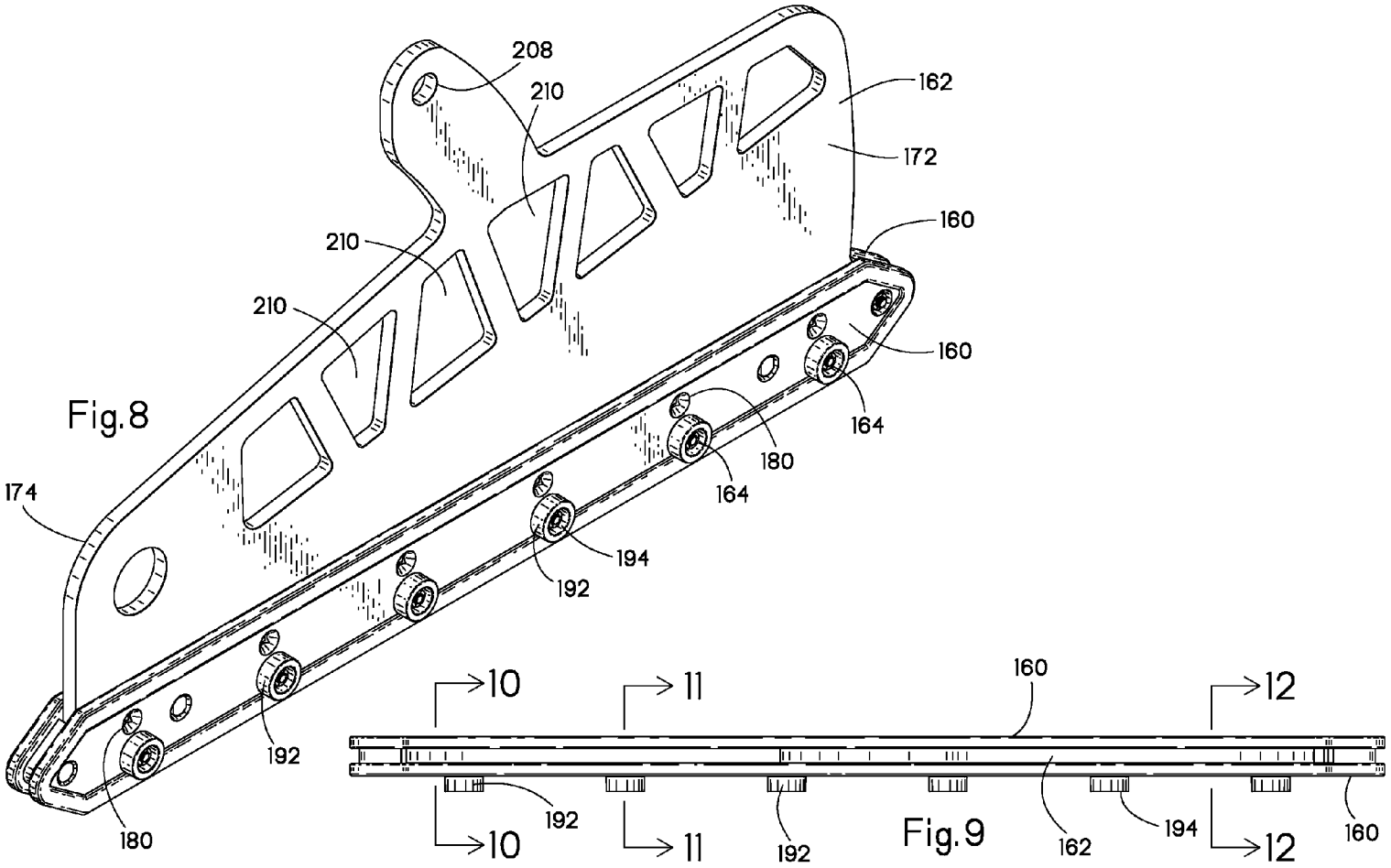
FIG. 8 is a top perspective view of the present regulator plow blade with the present wear plates.
FIG. 9 is a plan elevation of the blade of FIG. 8.

Another feature of the present grader blade 160 is that it is hangable upon the pins 166 by a single operator, so that both blades of the assembly shown in FIG. 8 are readily changed in the field. It should be noted that the blades 160 are secured to the moldboard 162 using the fasteners 164, which pass through designated fastener openings 186 in the moldboard preferably located below the pins 166.

Figure 11:
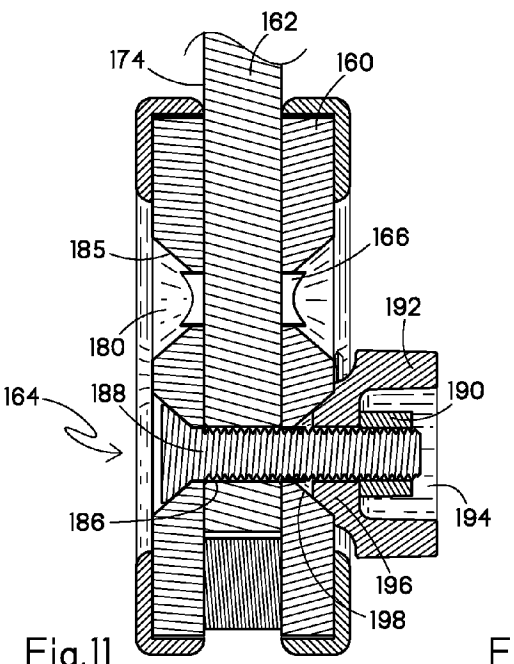
FIG. 11 is a cross-section taken along the line 11-11 of FIG. 9 and in the direction generally indicated.

Referring now to FIGS. 11 and 12, the fastener 164 includes a countersunk bolt 188, a nut 190 and a sacrificial nut cap 192. The nut cap 192 has an open end 194 dimensioned for accommodating the nut 190 and also defining sufficient clearance for accommodating a conventional ratchet socket. In addition, the open end 194 defines a protective shield around the nut 190, which is exposed to the abrasive environment of the rail ballast, thus protecting the nut facets for when it is time to remove the blade 160.

Opposite the open end 194, the nut cap 192 has a conical end 196 insertable into a corresponding flared mounting opening 198 in the blade 160 which is in registry with the fastener openings 186 in the moldboard 162 so that the fastener 164 holds the blades 160 against the moldboard by passing through the corresponding openings 186 and 198. Thus, the conical end 196 is lockingly secured in the opening 198 due to the complementary conical/flared shapes of these two components.

Figure 10:
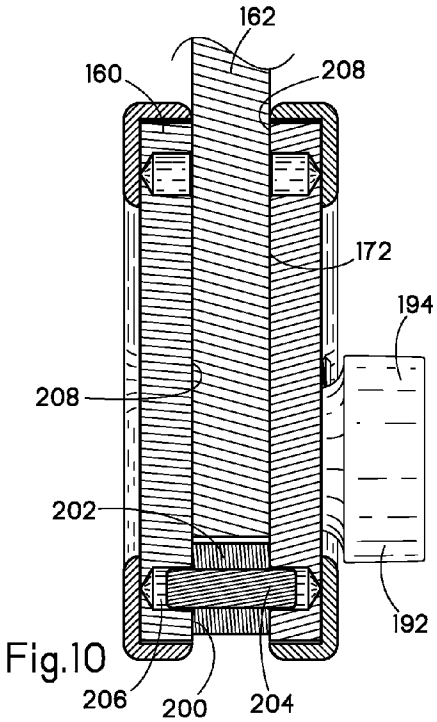
FIG. 10 is a cross-section taken along the line 10-10 of FIG. 9 and in the direction generally indicated.

Referring now to FIG. 10, another feature of the present moldboard 162 and blades 160 is that with the installation of the blades, it will be seen that a gap 200 is defined. Absent any corrective measures, during use of the moldboard 162 and blades 160 during the ballast regulating process, large particles of ballast can become wedged in the gap 200 and are difficult to remove, and in some cases deform the blades to the extent that they are difficult to remove. To address this problem, the present regulator 10 includes a filler bar 202 extending the length of the gap 200, being basically the same length as the blades 160. As seen in FIG. 10, the filler bar 202 is dimensioned to basically fill the gap 200 and is sandwiched between the blades 160.

Included in the filler bar 202 are several axially spaced, laterally extending lugs 204 engaging corresponding recesses 206 formed in inside edges 208 of the blades 160. Upon securing the blades 160 to the moldboard 162 using the fasteners 164, the filler 202 bar is securely held in place and also prevents entry of ballast into the gap 200. It is contemplated that a single operator can hang the two blades 160 on the moldboard 162 using the pins 166, then assemble the filler bar 202 as seen in FIG. 10, and then insert fasteners 164 to secure the entire assembly together, with the filler bar 202 sandwiched between the blades.

Returning now to FIG. 8, it will be seen that the moldboard 162 is provided with at least one eyelet 208 for attachment to the wings 62*a*, 62*b*. Also, as known in the art, the moldboard 162 is optionally provided with windows 210 for reducing weight.

While a particular embodiment of the present roadworthy ballast regulator has been shown and described, it will be appreciated by those skilled in the art that changes and modifications may be made thereto without departing from the invention in its broader aspects and as set forth in the following claims.

What is claimed:

1. A regulator wing blade and wear plate assembly, comprising:

a moldboard having at least one pin extending transversely to the moldboard, said pin including a central portion fixed to a corresponding opening in said moldboard, and having a notch with a surface inclined from an outer end of said pin toward said moldboard;

at least one grader blade having at least one mounting opening having a flared, inclined surface complementary to said notch so that said blade is hangable on said pin and so that said notch draws said blade against said moldboard.

2. The assembly of claim 1 wherein each said pin includes a portion extending from a corresponding outer surface of said moldboard, and said inclined surface forms a frusto-conical shape tapering or narrowing from an outer end of said pin toward said blade.

3. The assembly of claim 1 wherein said moldboard includes first and second outer surfaces, and at least one of said pins includes ends having said inclined surfaces extending from each said surface, and each said pin includes a vertically projecting shoulder at a narrow end of said notch, said shoulder forming a locating point for receiving said corresponding mounting opening on said grader blade for positioning said grader blade on said moldboard.

4. The assembly of claim 1 wherein each said pin includes a pair of axially extending mounting portions defining frusto-conical shapes tapering toward said moldboard.

5. The assembly of claim 4 including a pair of said grader blades each mounted to corresponding surfaces of said moldboard, lower edges of said wear plates defining a gap and a filler bar disposed in said gap and sandwiched between said blades.

6. The assembly of claim 5 wherein each said grader blade has at least one recess formed in an inner surface, and said filler bar is provided with a corresponding number of laterally extending lugs projecting from opposite sides of said filler bar and constructed and arranged for engaging said recesses so that said filler bar is secured between said blades upon assembly to said moldboard.

7. The assembly of claim 3 further including a pair of said grader blades, each mountable to a corresponding surface of said moldboard, and at least one threaded fastener securing said blades to said moldboard, and further including a sacrificial nut cap configured for accommodating a nut engaging said fastener and also accommodating a socket for removing said nut.

8. A regulator wing blade and wear plate assembly, comprising:

a moldboard having at least one pin extending transversely to the moldboard, said pin including a central portion fixed to a corresponding opening in said moldboard, and having a notch with a surface inclined from an outer end of said pin toward said moldboard;

at least one grader blade having at least one mounting opening having a flared, inclined surface complementary to said notch so that said blade is hangable on said pin and so that said notch draws said blade against said moldboard;

a pair of said grader blades each mounted to corresponding surfaces of said moldboard, lower edges of said wear plates defining a gap and a filler bar disposed in said gap and sandwiched between said blades; and each said grader blade has at least one recess formed in an inner surface, and said filler bar is provided with a corresponding number of extending lugs constructed and arranged for engaging said recesses so that said filler bar is secured between said blades upon assembly to said moldboard.

* * * * *